US005276479A

United States Patent [19]

Inomata

[11] Patent Number: 5,276,479

[45] Date of Patent: Jan. 4, 1994

[54] PROCESS CARTRIDGE HAVING PLURAL DEVELOPING UNITS AND IMAGE FORMING APPARATUS CAPABLE OF MOUNTING PROCESS CARTRIDGE

[75] Inventor: Mitsugu Inomata, Kawasaki, Japan

[73] Assignee: Canon Kabushiki Kaisha, Tokyo, Japan

[21] Appl. No.: 844,831

[22] Filed: Mar. 2, 1992

[30] Foreign Application Priority Data

Mar. 1, 1991 [JP] Japan ..... 3-057607
Feb. 13, 1992 [JP] Japan ..... 4-058788

[51] Int. Cl.[5] ..... G03G 15/00; G03G 15/01

[52] U.S. Cl. ..... 355/200; 355/210; 355/245; 355/326

[58] Field of Search ..... 355/200, 211, 245, 326, 355/327, 203, 206; 118/645

[56] References Cited

U.S. PATENT DOCUMENTS 4,500,195 2/1985 Hosono ..... 355/208
4,933,718 6/1990 Furuya ..... 355/203
5,099,278 3/1992 Sato ..... 355/200

FOREIGN PATENT DOCUMENTS 63-214778 9/1988 Japan ..... 355/245

*Primary Examiner*—Joan H. Pendegrass
*Attorney, Agent, or Firm*—Fitzpatrick, Cella, Harper & Scinto

[57] ABSTRACT

A process cartridge suitable for use in a multi-color image forming apparatus has an image carrier such as an electrophotosensitive drum, a plurality of developing units which act on the image carrier to form developed images of different colors, and a developing unit change-over device for performing change-over between the developing units so as to put one of the developing units into an operative state. The developing unit change-over device is controlled in accordance with a signal from a sensor mounted in the body of the image forming apparatus that senses the state of the developing unit change-over device. The image forming apparatus which operates with the process cartridge has a mounting structure for mounting the process cartridge, a driving device for driving the developing unit change-over device in the process cartridge mounted on the mounting structure, a sensor for sensing the state of the developing unit change-over device in the process cartridge mounted on the mounting structure, and a control device for controlling the operation of the developing unit change-over device in accordance with a signal output from the sensor.

28 Claims, 15 Drawing Sheets

FIG. 17

ROM TABLE

| PRESENT POSITION | NEXT POSITION | NUMBER OF STEPS |
|---|---|---|
| INITIAL POSITION | Y DEVELOP UNIT 8a | $x_1$ |
| INITIAL POSITION | M DEVELOP UNIT 8b | $x_2$ |
| INITIAL POSITION | C DEVELOP UNIT 8c | $x_3$ |
| INITIAL POSITION | Bk DEVELOP UNIT 8d | $x_4$ |
| Y DEVELOP UNIT 8a | M DEVELOP UNIT 8b | $x_5$ |
| Y DEVELOP UNIT 8a | C DEVELOP UNIT 8c | $x_6$ |
| Y DEVELOP UNIT 8a | Bk DEVELOP UNIT 8d | $x_7$ |
| M DEVELOP UNIT 8b | C DEVELOP UNIT 8c | $x_8$ |
| M DEVELOP UNIT 8b | Bk DEVELOP UNIT 8d | $x_9$ |
| C DEVELOP UNIT 8c | Bk DEVELOP UNIT 8d | $x_{10}$ |

PROCESS CARTRIDGE HAVING PLURAL DEVELOPING UNITS AND IMAGE FORMING APPARATUS CAPABLE OF MOUNTING PROCESS CARTRIDGE

BACKGROUND OF THE INVENTION

1. Field of the Invention

The present invention relates to a process cartridge having a plurality of developing units and also to an image forming apparatus on which the process cartridge is mountable.

The term "image forming apparatus" in this specification is used to mean various types of apparatuses and machines such as electrophotographic copying machines, printers including laser beam printers, facsimile machines, and so forth. Although a process cartridge and a multi-color image forming apparatus are specifically mentioned in the following description, it is to be understood that such devices are only illustrative and the present invention may generally apply to a variety of types of process cartridges having a plurality of developing units and image forming apparatuses which operate in cooperation with such process cartridges.

2. Description of the Related Art

Process cartridges for use in multi-color image forming apparatuses have been known.

In general, such a process cartridge has an image carrier and a plurality of developing units which act on the image carrier, as disclosed, for example, in U.S. Pat. No. 4,500,195. The process cartridge, as well as the multi-color image forming apparatus which forms multi-color images by using such a process cartridge, is essentially required to have a construction which enables the developing units to operate correctly without impairing the ease of mounting and demounting of the process cartridge on and from the apparatus.

SUMMARY OF THE INVENTION

Accordingly, an object of the present invention is to provide a process cartridge which ensures correct operation of a plurality of developing units incorporated therein, and further provides an image forming apparatus which can mount such a process cartridge.

Another object of the present invention is to provide a process cartridge and an image forming apparatus with improved facility for mounting and demounting of the process cartridge on and from the image forming apparatus.

Still another object of the present invention is to provide a process cartridge which is improved, without any substantial rise of cost, so as to ensure correct operation of the developing units incorporated therein, as well as an image forming apparatus on which the process cartridge is mounted and used.

A further object of the present invention is to provide a process cartridge having a plurality of developing units, improved to facilitate mounting and demounting while preventing erroneous operation of a developing unit change-over mechanism and reducing the cost of both the process cartridge, and the multi-color image forming apparatus.

A still further object of the present invention is to provide an image forming apparatus which has means for detecting any mounting failure of a process cartridge.

The invention in one aspect pertains to a process cartridge which can be mounted on an image forming apparatus, comprising: an image carrier; a plurality of developing units which act on the image carrier; and a developing unit change-over means for performing change-over between the the plurality of developing units so as to put one of the developing units into an operative state, the developing unit change-over means being controlled in accordance with a signal from sensing means mounted in the image forming apparatus, for sensing the state of the developing unit change-over means.

The invention in another aspect pertains to an image forming apparatus which can mount a process cartridge including an image carrier, a plurality of developing units which act on the image carrier and a developing unit change-over means for performing change-over between the plurality of developing units so as to put one of the developing units into an operative state, the image forming apparatus comprising: mounting means for mounting the process cartridge; driving means for driving the developing unit change-over means in the process cartridge mounted on the mounting means; sensing means for sensing the state of the developing unit change-over means in the process cartridge mounted on the mounting means; and control means for controlling the operation of the developing unit change-over means in accordance with a signal output from the sensing means.

The invention in a further aspect pertains to a multi-color image forming apparatus, comprising mounting means for demountably mounting a process cartridge including a plurality of developing units, an image carrier and a developing unit change-over means having a change-over member; a drive motor for driving the change-over member of the developing unit change-over means; a sensor for sensing the state of the change-over member of the developing unit change-over means; and control means for controlling the change-over member from an exterior of the process cartridge in accordance with a signal from the sensor.

The invention in a yet further aspect pertains to an image forming apparatus, an image forming apparatus, comprising: mounting means for demountably mounting a process cartridge including an image carrier, and a plurality of developing units which act on the image carrier; a driving power source; a power transmission means for transmitting driving power from the driving power source to the process cartridge mounted on the mounting means; and sensing means for sensing the mounting state of the process cartridge on the mounting means. The above and other objects, features and advantages of the invention will become clear from the following description of the preferred embodiments when the same is read in conjunction with the accompanying drawings.

BRIEF DESCRIPTION OF THE DRAWINGS

FIG. 17 is a ROM table;

DESCRIPTION OF THE PREFERRED EMBODIMENTS

A full-color printer as a preferred embodiment of the image forming apparatus of the invention will be described with reference to FIGS. 1 to 4.

In this embodiment, a developing unit change-over mechanism has a cam provided in a process cartridge, while a sensor for sensing the state of the cam is provided in the body of the full-color printer. The cam of the developing unit change-over mechanism provided in the process cartridge is controlled in accordance with a signal provided by the sensor. Since the sensor is provided in the body of the full-color printer, it is not necessary to provide electrical connection between the process cartridge and the printer body which otherwise would be necessary to exchange electrical sensor signals between the process cartridge and the printer body. Consequently, noise contained in the sensor signal is reduced to suppress erroneous operation of the developing unit change-over mechanism. In addition, mounting and demounting of the process cartridge on and from the printer body are facilitated and the cost of the whole apparatus is reduced.

Figure 4:
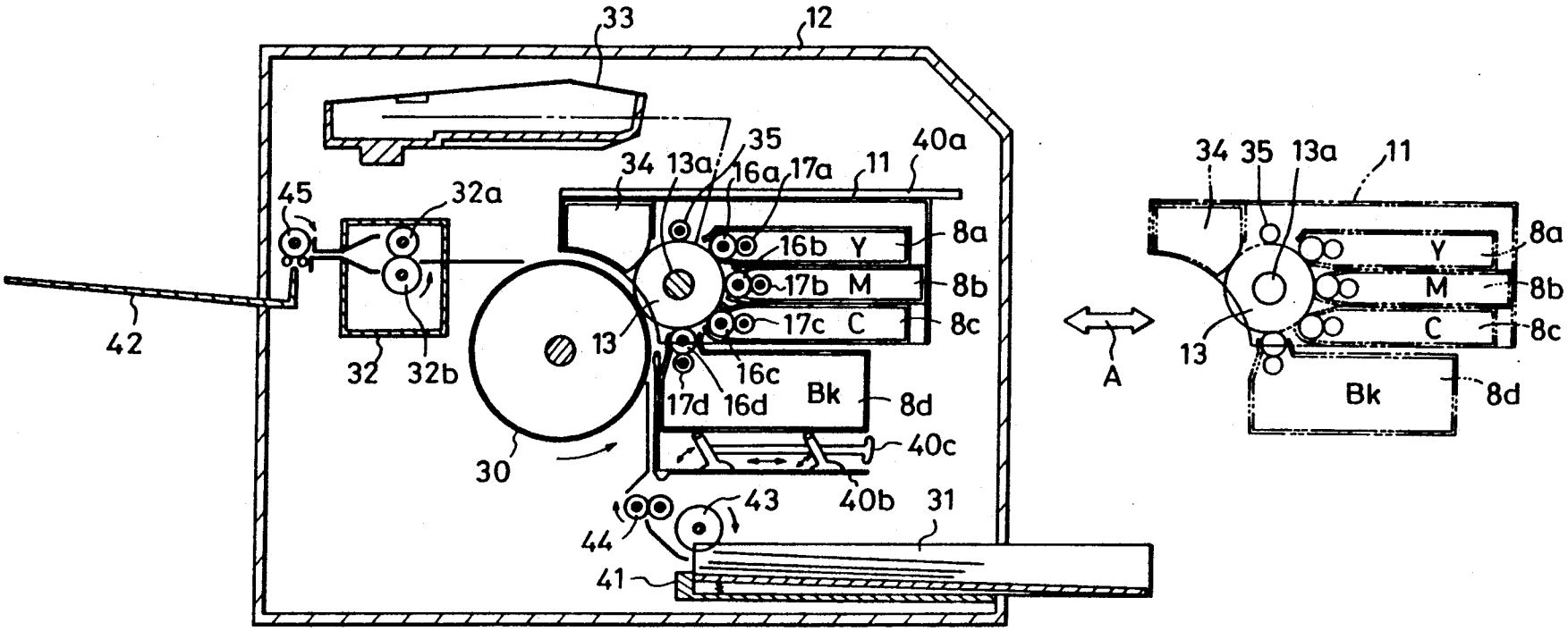
FIG. 4 is a cross-sectional view of the multi-color image forming apparatus.

Referring first to FIG. 4, a full-color printer has a printer body 12 which contains various components including mounting means 40*a*, 40*b* for mounting a process cartridge 11, a transfer drum 30, mounting means 41 for mounting a sheet feeder cassette 31, a fixing device 32 including a heat roller 32*a* and a pressing roller 32*b*, a scanner unit 33, an ejection tray 42, a feed roller 43, a register roller 44, an ejection roller 45, and so forth. The process cartridge 11 has an independent structure composed of an image carrier 13, such as an electrophotosensitive member, a plurality of developing units 8*a*, 8*b*, 8*c* and 8*d* (collectively denoted by reference numeral 8), a cleaner 34 and a charging roller 35. The process cartridge 11 is adapted to be mounted on and demounted from the printer body 12 by being moved in the directions of the double-headed arrow A in FIG. 4. More specifically, for mounting the process cartridge 11, the user sets the process cartridge 11 on the mounting means 40*a*, 40*b* and then pulls a lever 40*c* so that the process cartridge 11 is raised to an operative position as illustrated. The developing units 8*a*, 8*b*, 8*c* and 8*d* contain developing agents of yellow, magenta, cyan, and black colors, respectively.

Figure 1:
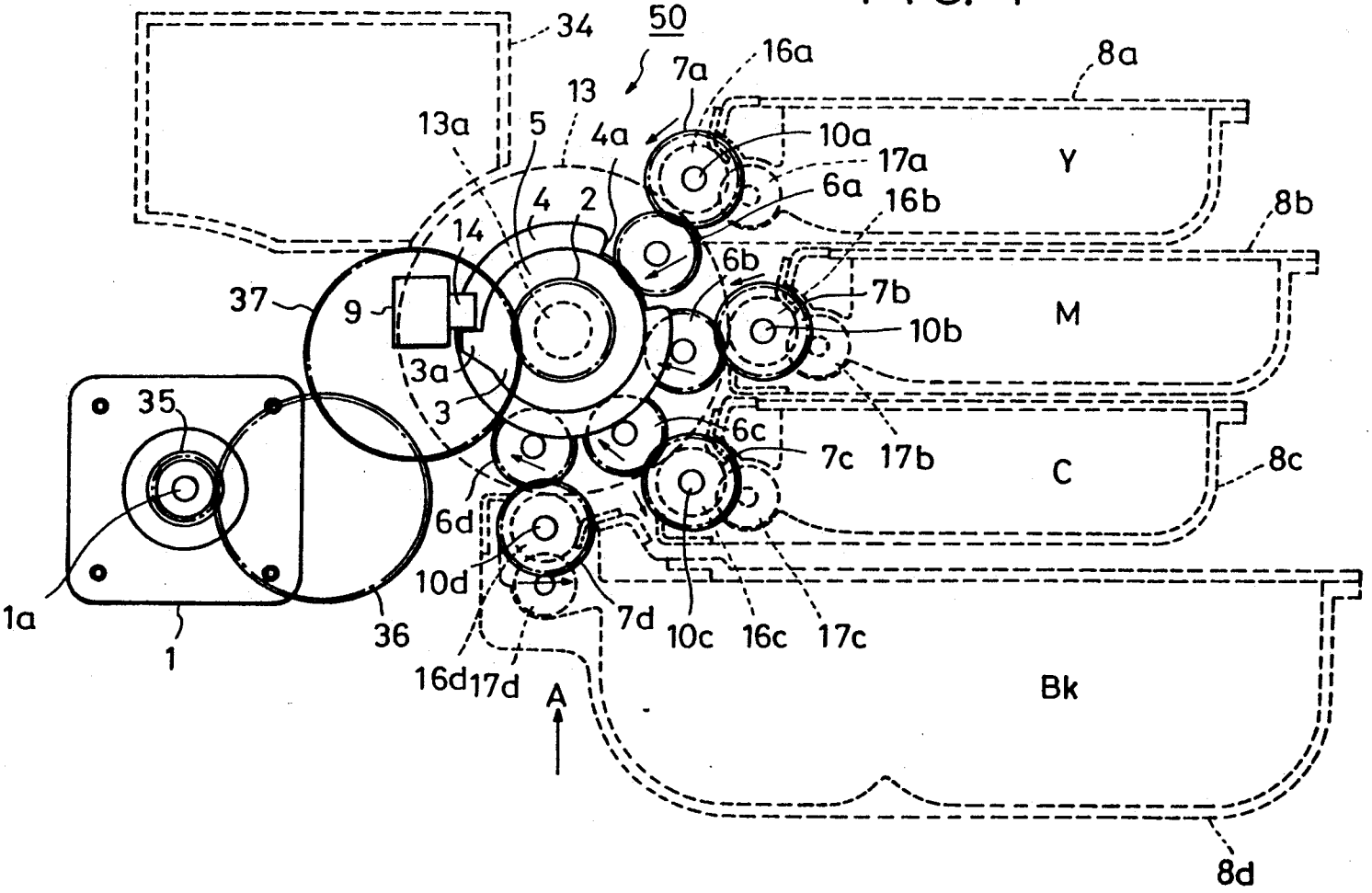
FIG. 1 is a side elevational view of a multi-color image forming apparatus as a first embodiment of the image forming apparatus of the present invention, showing particularly a critical portion of the apparatus including a developing unit change-over mechanism.
Figure 2:
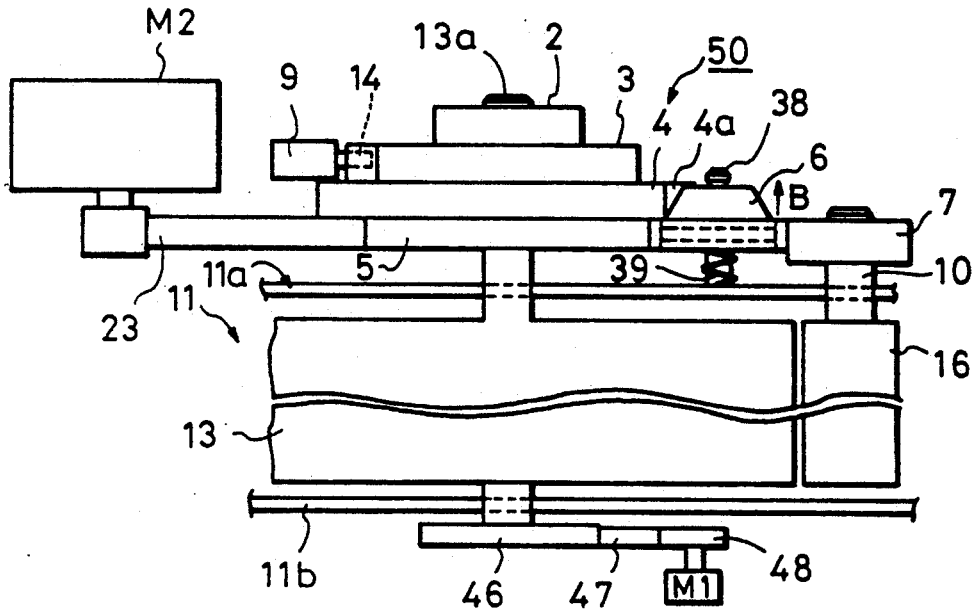
FIG. 2 is an illustration of the multi-color image forming apparatus as viewed in the direction of an arrow A of FIG. 1, showing one step of the operation of the developing unit change-over mechanism.
Figure 3:
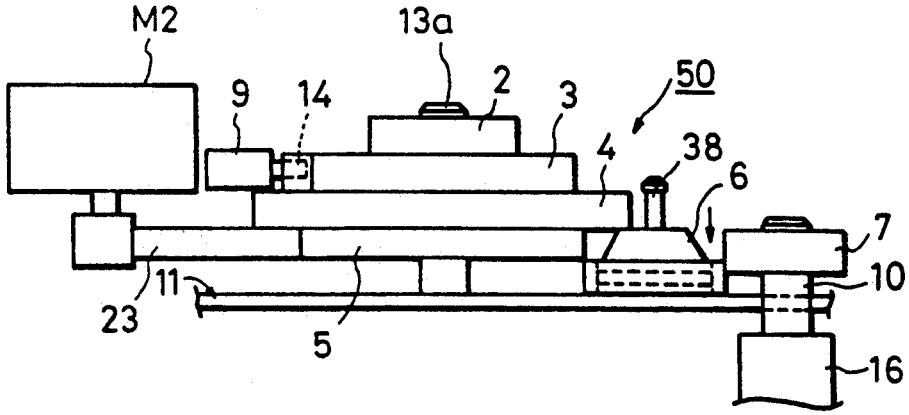
FIG. 3 is an illustration of the multi-color image forming apparatus as viewed in the direction of the arrow A of FIG. 1, showing another step of the operation of the developing unit change-over mechanism.

As shown in FIG. 1, the process cartridge 11 has a developing unit change-over mechanism 50 which performs a change-over between the developing units 8, i.e., transmission of a driving power from the printer body 12 to a selected one of the developing units 8 to drive it. The developing unit change-over mechanism 50 includes a cam 4 which is rotatably supported by a shaft 13*a* of the image carrier 13. The peripheral edge of this cam 4 is recessed at a portion thereof to provide an indent 4*a*. The cam 4 also integrally includes a gear 2 and a sensed member 3 which is adapted to be sensed by a later-mentioned sensor. The sensed member 3 has a projection 3*a* projecting from the outer peripheral surface thereof.

A gear 5 is fixed to the shaft 13*a* of the image carrier 13. The gear 5 is adapted to be selectively engaged by one of shift gears 6*a*, 6*b*, 6*c*, and 6*d* (collectively denoted by reference numeral 6) which are associated with the developing units 8*a*, 8*b*, 8*c* and 8*d*. As will be seen from FIG. 2, the shift gears 6 are vertically movable along a shaft 38 and are biased in the direction of an arrow B in FIG. 2 for engagement with the gear 5. The shift gears 6*a*, 6*b*, 6*c*, and 6*d* engage with gears 7*a*, 7*b*, 7*c*, and 7*d* (collectively denoted by reference numeral 7) which are affixed to ends of drive shafts 10*a*, 10*b*, 10*c* and 10*d* (collectively denoted by reference numeral 10) of the respective developing units 8. The drive shafts 10 are fixed to developing sleeves 16*a*, 16*b*, 16*c* and 16*d* (collectively denoted by reference numeral 16). The gears 7 rotatingly drive application rollers 17*a*, 17*b*, 17*c*, and 17*d* (collectively denoted by reference numeral 17). Each developing roller 17 plays a double role: namely, it supplies the developing agent to the associated developing sleeve 16 and removes any residual developing agent from the sleeve 16.

On the other hand, with reference to FIG. 1 and FIG. 4, the printer body 12 has a drive motor 1 which drives the cam 4 provided in the process cartridge 11. A gear 35 which is fixed to the output shaft la of the drive motor 1 meshes with the aforementioned gear 2 of the developing unit change-over mechanism 50 in the process cartridge 11 through gears 36 and 37. The gears 35, 36 and 37 are disposed in the printer body 12.

The printer body 12 also has the aforementioned sensor 9 which senses the state of the cam 4 in the process cartridge 11. The sensor 9 has a button portion 14 adapted to produce an N signal when pressed by the projection 3*a* of the sensed member 3. Upon receipt of this signal, a control unit 100 (see FIG. 18) on the printer body 12 determines the state of the cam 4, i.e., the rotational phase or position at which the cam 4 is stopped.

A gear 46 (see FIG. 2) on the process cartridge 11 is driven by a main motor Ml on the printer body 12, via gears 47 and 48, thereby rotating the image carrier 13 at a predetermined speed. Numerals 11*a* and 11*b* denote a frame of the process cartridge 11.

The torque of the drive motor 1 on the printer body 12 is transmitted to the sensed member 3 and also to the cam 4 through gears 35, 36, 37, (see FIG. 1) and 2, so that the sensed member 3 and the cam 4 are rotated as a unit. When the cam 4 rotates, one of the developing units 8 which is associated with the shift gear 6 confronting the indent 4*a* of the cam 4 is selected and put into developing operation. In the state shown in FIG. 1, the developing unit 8*a* is selected and put into operation. More specifically, as indicated by the arrow B in FIG. 2, the shift gear 6 (6*a* in FIG. 1) facing the indent 4a of the cam 4 is moved by the urging force of the spring 39 upward along the shaft 38 from a lower retracted position where it does not engage with the gear 5 to an upper operative position where it meshes with the gear 5. Consequently, the rotation of the gear 5 is transmitted to the drive shaft 10*a* of the developing unit 8*a* through the gear 7, so that the developing unit 8*a* is driven to perform the developing process. Namely, the developing sleeve 16 and the application roller 17 are rotated so as to develop a latent image on the image carrier 13 such as a drum, in one of the developing units 8 which is selected by the cam 4 under the control of the control unit 100 in the printer body 12. When the indent 4*a* of the cam 4 becomes out of phase with the shift gear 6 (6*a* in this case), the shift gear 6 is pressed downward by the end portion of the cam 4 so as to be disengaged from the gear 5. As a consequence, the transmission of the driving torque to the drive shafts 10 of the developing units 8 is terminated to stop the driving unit 8.

Other developing units 8 are selected and put into development as they are selected as a result of rotation of the cam 4 which is driven in response to the signal issued in accordance with the nature of the image to be printed by the control unit 100 of the printer body 12. The driving torque for driving the developing unit 8 is derived from a developing unit drive motor M2 which actuates the gear 5 through a gear 23.

As noted previously, the sensed member 3 rotates as a unit with the cam 4. Consequently, the projection 3*a* of the sensed member 3 presses the button portion 14 of the sensor 9 on the printer body 12, thereby turning the sensor 9 on. It is thus possible to sense the state of the cam 4 by the sensor 9. Namely, the control unit 100 which receives the signal from the sensor 9 determines the position of the projection 3*a* of the sensed member 3, i.e., the angular position of the indent 4*a* of the cam 4 relative to the sensor 9. The angular positional relationships between the driving positions, i. e., the positions of the shift gears 6*a*, 6*b*, 6*c* and 6*d* of the developing units 8*a*, 8*b*, 8*c*, and 8*d* in the process cartridge, are determined. There also exists a predetermined rotational positional relationship between the indent 4*a* of the cam 4 and the projection 3*a* of the sensed member 3. The control unit 100 on the printer body 12, therefore, can identify the developing unit (8*a* in this case) to be driven when the sensor 9 is turned on. Alternatively, the control unit 100 can identify which one of the driving units 8 is being driven, by measuring the angle of rotation of the cam 4 after the sensor 9 has been turned on. The control unit 100 thus controls the drive motor 1 on the basis of the signal given by the sensor 9. That is, the cam 4 in the process cartridge 11 is controlled by the control system which is in the printer body 12.

It will be understood that the described embodiment operates in response to the sensor signal from the sensor 9 which is disposed in the printer body 12, so that the necessity for electrical connection which would otherwise be required for the delivery of the electric sensor signal and electrical power is eliminated. Consequently, the sensor signal can be transmitted with a reduced level of noise to offer a higher accuracy of operation of the developing unit change-over mechanism 50. In addition, mounting and demounting of the process cartridge can be appreciably facilitated.

Furthermore, the cost of production of the process cartridge 11 can be reduced because the process controller as a consumable or disposable component does not the contain expensive sensor 9.

Figure 5:
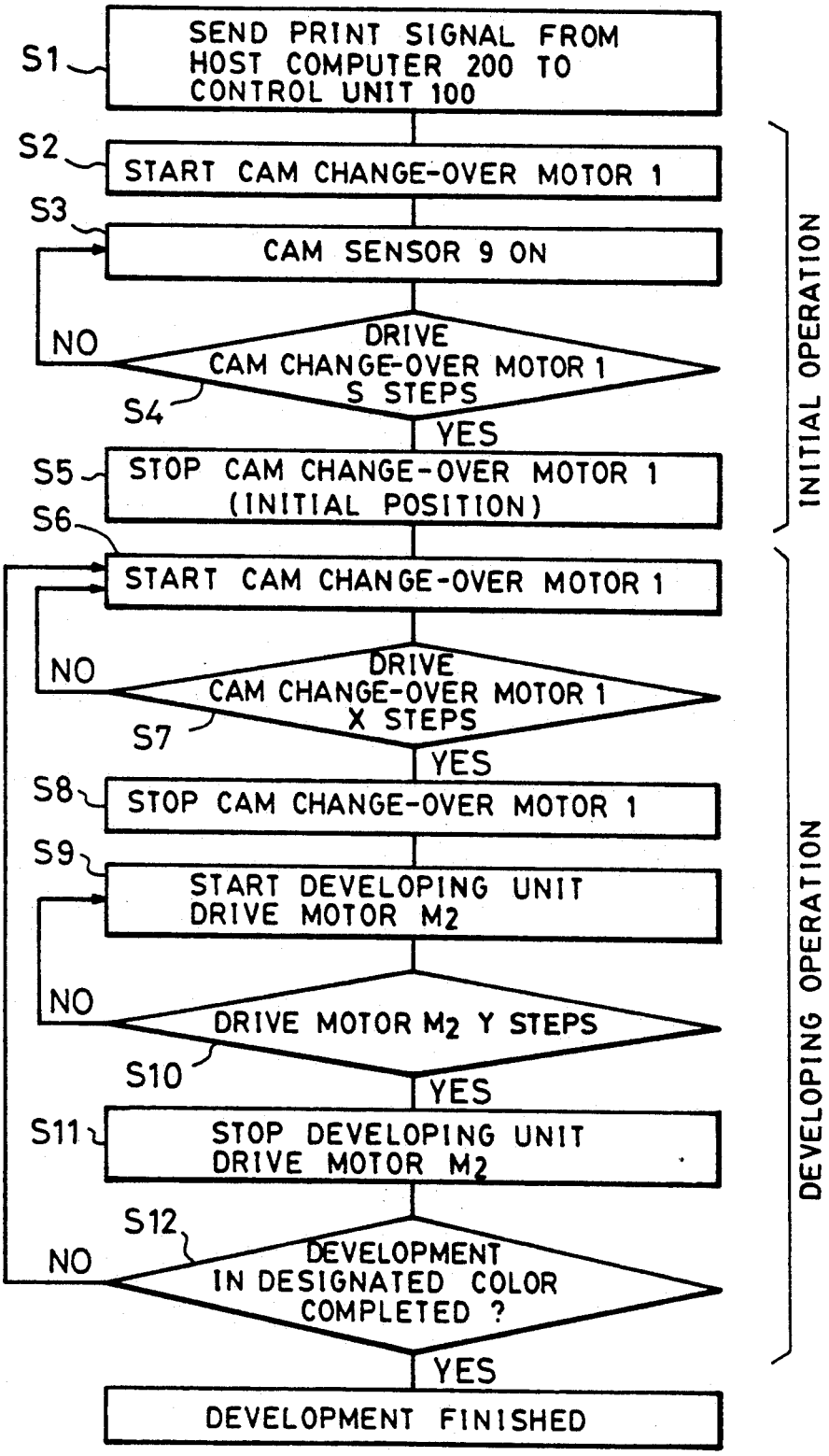
FIG. 5 is a flowchart illustrating the developing operation performed by the multi-color image forming apparatus.

The flow of the developing process will be described with reference to FIG. 5 which is a flowchart of this process.

In Step S1, a print signal is delivered from a host computer 200 into the control unit 100. In response to the print signal, the control unit 100 produces a signal thereby starting the cam change-over motor 1 in Step S2. This causes the sensed member 3 to rotate so that the projection 3*a* turns the sensor 9 on in Step S3. Subsequently, in Step S4, the change-over motor 1, which is a stepping motor, is driven S steps and then stopped, in Steps S4 and S5, thus completing the initializing operation. In Step S6, the change-over motor 1 starts to operate again and, in accordance with the image information given from the host computer 200, makes in Step S7 a predetermined number (X) steps which is necessary for selecting one of the developing units 8 of the first printing color. The motor 1 is then stopped in Step S8. The above-mentioned number X steps to be made by the motor 1 is stored in a ROM table provided in the control unit 100. A multiplicity of numbers X are stored in this ROM table as exemplarily shown in FIG. 17. For instance, for selecting the developing unit 8*d* for the Bk color when the printer has been just initialized, the motor 1 is required to make $X_4$ steps. Subsequently, the developing unit drive motor M2 is started in Step S9 and, in Step S10, the developing unit drive motor is driven a predetermined number Y of steps corresponding to the length of the region to be developed. The motor is then stopped in Step S11. Subsequently, Steps 6 through 11 are executed repeatedly in accordance with the image information given by the host computer 200, whereby printing is finished with all designated colors in Step S12. In the case of a full-color printing, the routine of steps 6 through 11 is repeated 4 times since all of the four colors are put into development. Obviously, this routine is executed only once when the image to be printed is monochromatic, e.g., black.

Figure 6:
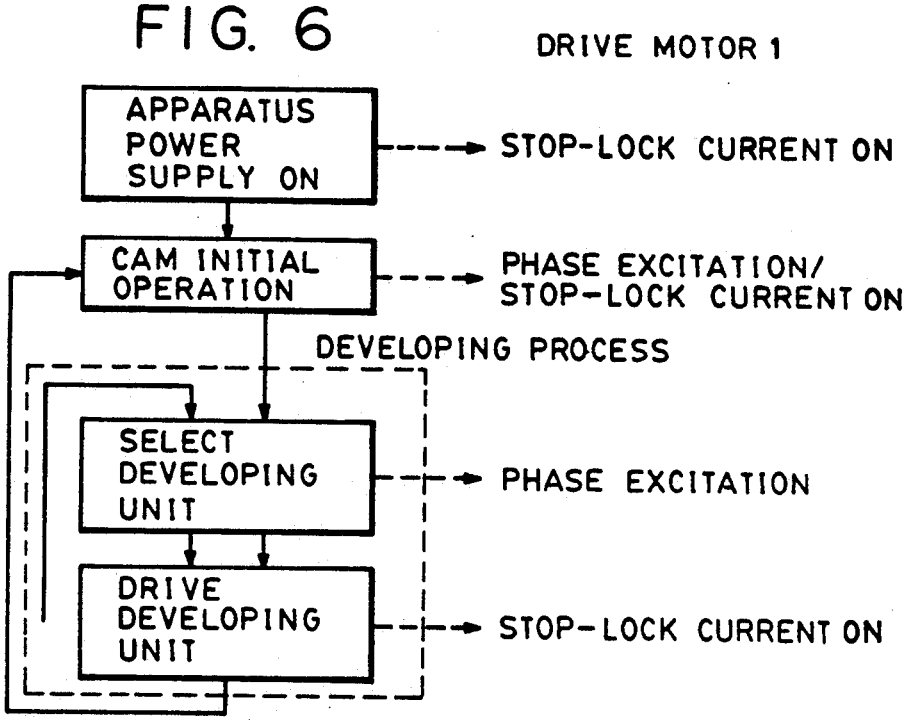
FIG. 6 is a flowchart illustrating a first example of a method for holding a cam at a stop position.
Figure 7:
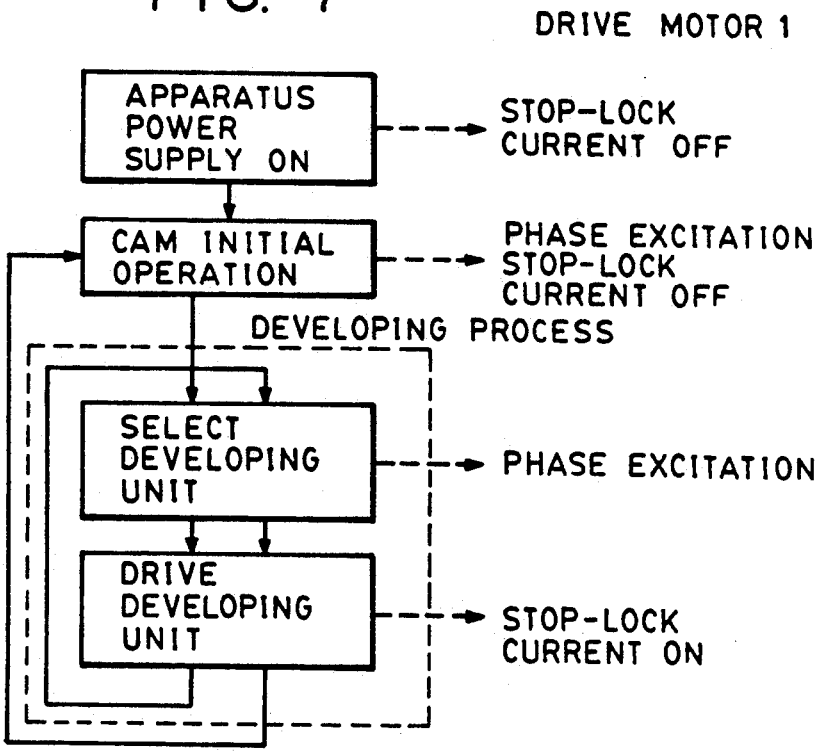
FIG. 7 is a flowchart illustrating a second example of a method for holding a cam at a stop position.
Figure 8:
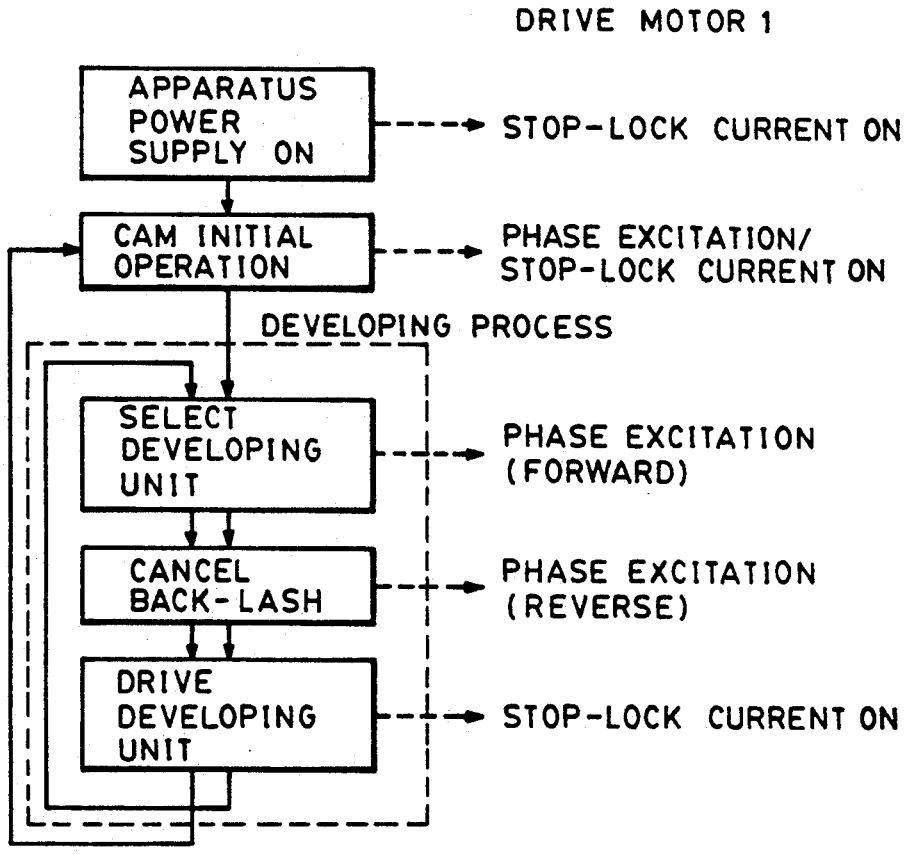
FIG. 8 is a flowchart illustrating a third example of a method for holding a cam at a stop position.

During the development, the cam 4 in the process cartridge 11 has to be locked in a stop position. FIGS. 6 to 8 illustrate methods for locking the cam 4 in the stop position.

As stated above, a stepping motor is used as the cam change-over motor 1 for driving the cam 4. As will be seen from FIG. 6, a stop lock current is supplied to the drive motor 1 simultaneously with the turning on of the printer apparatus as a whole. The drive motor 1 is then supplied with a phase excitation signal to enable initialization of the cam 4 and selection of the developing unit 8. After the completion of the selection, the motor 1 is supplied again with stop lock current, whereby the cam 4 is locked in the stop position during the operation of the developing unit 8 which has been selected as a result of selection of the cam 4. It is therefore possible to prevent any offset or deviation of the cam 4 from the correct stop position without requiring any specific means such as an offset-prevention oil damper to be incorporated inside the process cartridge, i.e., by locking means which is external of the process cartridge 11. When no developing unit 8 is operating, the level of the stop lock current may be cut off or reduced to prevent unnecessary heating of the drive motor 1.

FIG. 7 shows an alternative method for locking the cam 4. In this case, the drive motor 1 is not supplied with stop lock current either when the power supply of the printer is turned on or when the initialization of the cam 4 is finished. The drive motor 1, however, is supplied with the stop lock current during the operation of the developing units 8 selected by the operation of the cam 4. After switching and driving of the developing units 8 is completed to form the desired print, the cam 4 is set again to the initial position and then the stop lock current is turned off. Instead of means for turning the stop lock current on and off in a controlled manner, an operation amplifier or other suitable means may be used to chop the driving current supplied to the drive motor 1. In such a case, the level of the drive current is switched between high and low levels to selectively lock and unlock the drive motor 1.

FIG. 8 shows an arrangement in which, after a developing unit 8 is selected, the drive motor 1 is reversed a suitable number of steps corresponding to the total backlash of the gear train composed of the gears 35, 36, 37 and 2, followed by the driving of one of the selected developing units 8. With this arrangement, it is possible to enhance the precision of the position control for holding the cam 4, because the influence of the backlash in the gear train is canceled.

Figure 9:
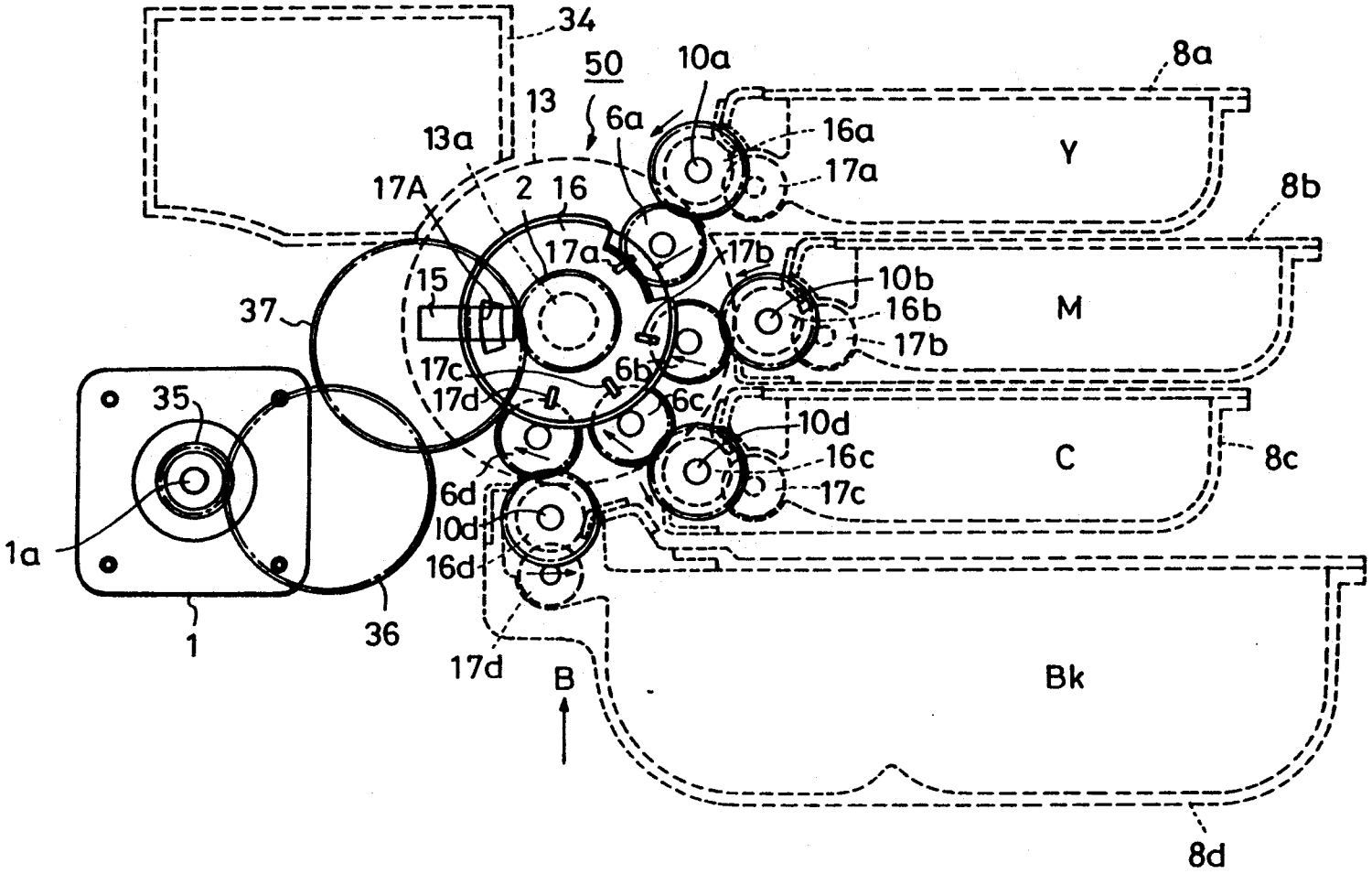
FIG. 9 is a side elevational view of a multi-color image forming apparatus as a second embodiment of the image forming apparatus of the present invention, showing particularly a critical portion of the apparatus including a developing unit change-over mechanism.
Figure 10:
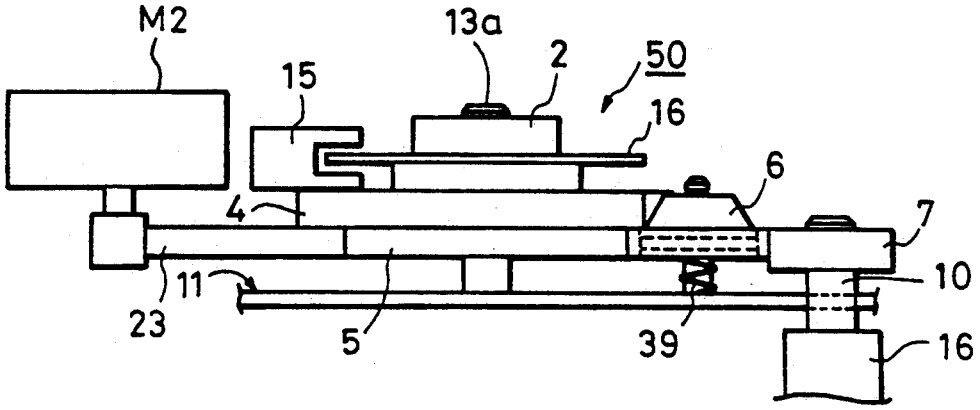
FIG. 10 is an illustration of the multi-color image forming apparatus as viewed in the direction of an arrow B of FIG. 9.

A full-color printer, as a second embodiment of the image forming apparatus of the present invention, now will be described with specific reference to FIG. 9 which is a side elevational view of a full-color printer showing particularly a critical portion including the development unit change-over mechanism and FIG. 10 which is an illustration of the printer as viewed in the direction of an arrow B in FIG. 9.

This embodiment employs a disk-shaped sensed member 16 which is provided with one wide slot 17A and four narrow slits **17*a*, 17*b*, 17*c* and 17*d* (collectively denoted by reference numeral 17**).

A light transmission type optical sensor 15 is provided in the printer body. The sensor 15 is capable of sensing presence of the slots 17A and 17. According to this arrangement, the control unit recognizes and identifies one of the selected developing units 8 (either **8*a*, 8*b*, 8*c* or 8*d*), i.e., the color of the developing agent (toner) which is to be used, on the basis of the number of narrow slits 17 counted after the detection of the wide slit 17A, and controls the switch-over of the developing units 8** on the basis of this information.

Figure 12:
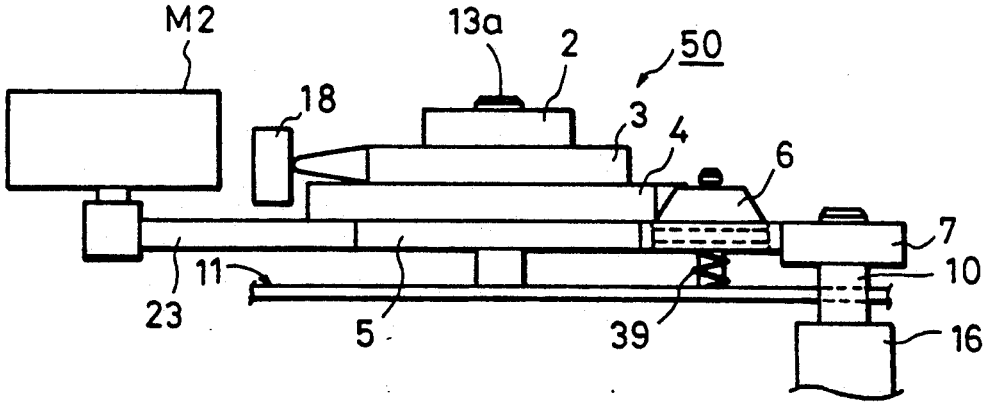
FIG. 12 is an illustration of the multi-color image forming apparatus as viewed in the direction of an arrow C of FIG. 11.
Figure 11:
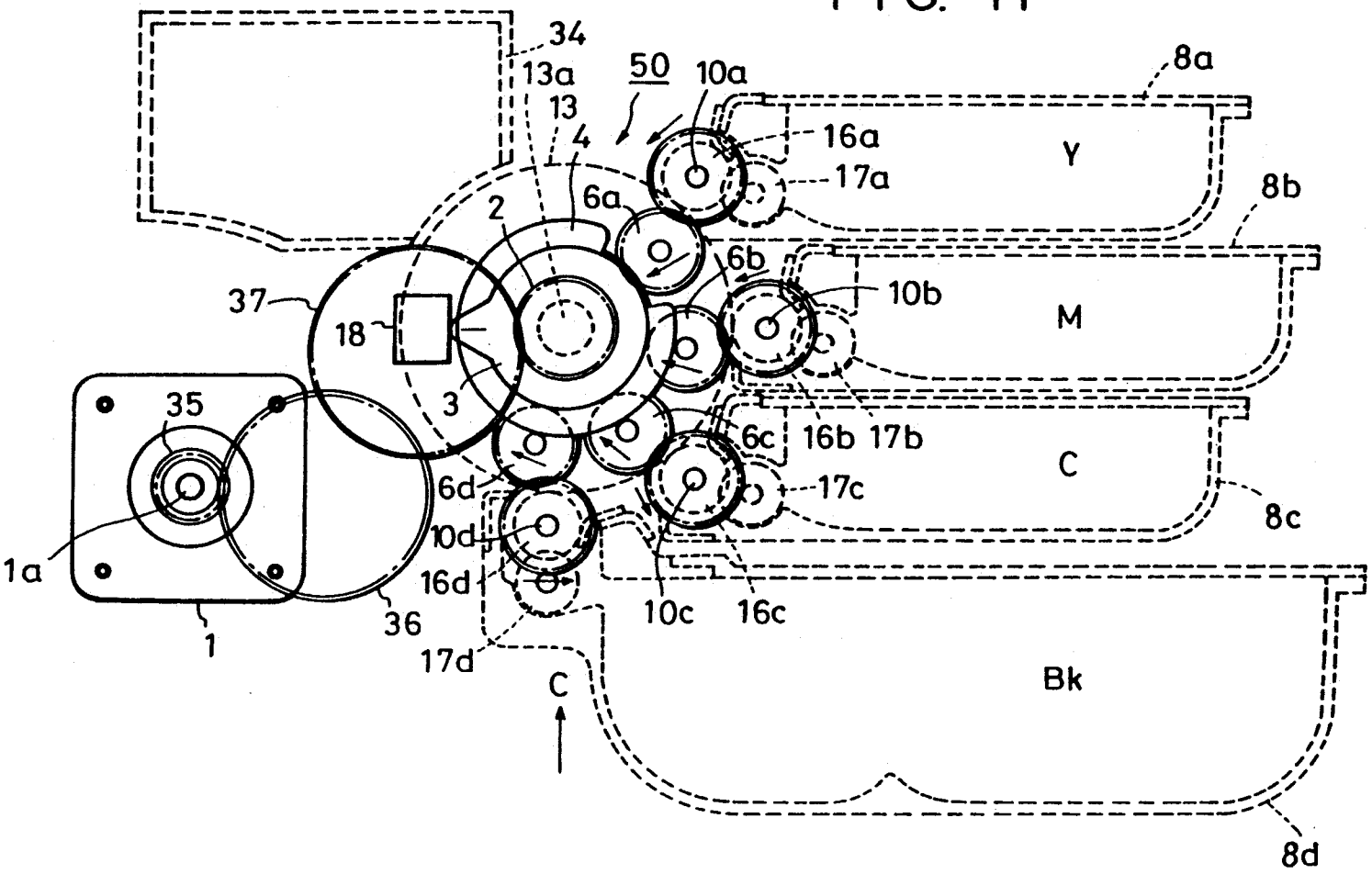
FIG. 11 is a side elevational view of a multi-color image forming apparatus as a third embodiment of the image forming apparatus of the present invention, showing particularly a critical portion of the apparatus including a developing unit change-over mechanism.

A full-color printer, as a third embodiment of the image forming apparatus of the present invention, will be described with specific reference to FIG. 11 which is a side elevational view of a full-color printer showing particularly a critical portion including the development unit change-over mechanism and FIG. 12 which is an illustration of the printer as viewed in the direction of an arrow C in FIG. 11.

While the preceding two embodiments employ a push-to-operate type sensor 9 (see FIG. 1) and an optical sensor 15 (see FIG. 9), respectively, the third embodiment employs a piezoelectric sensor 18. The third embodiment, therefore, is free of the troubles caused by the effect caused by contamination of the by the developing agent (toner), e.g., mal-function of the sensor 9 of he first embodiment or deposition of the developing agent (toner) on the light emitting/receiving portions of the optical sensor 15 used in the second embodiment.

Figure 13:
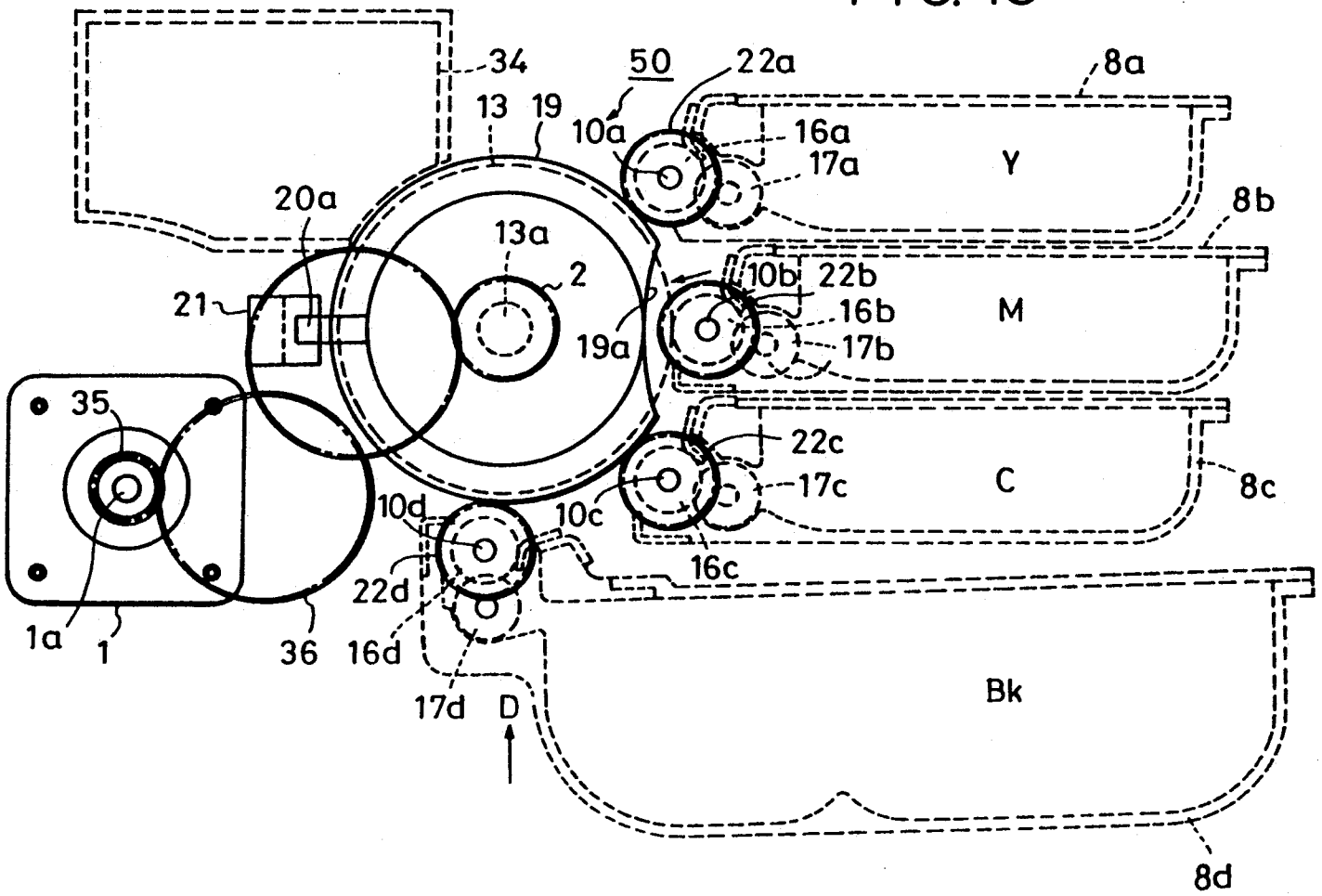
FIG. 13 is a side elevational view of a multi-color image forming apparatus as a fourth embodiment of the image forming apparatus of the present invention, showing particularly a critical portion of the apparatus including a developing unit change-over mechanism.
Figure 14:
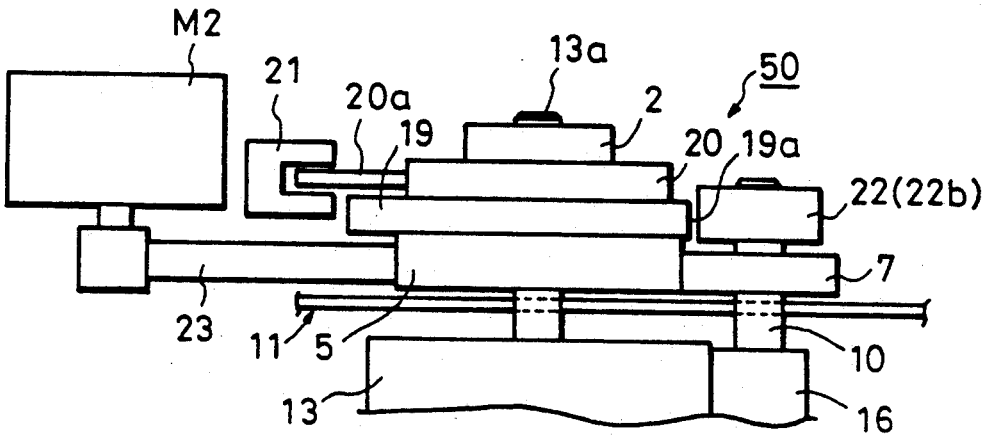
FIG. 14 is an illustration of the multi-color image forming apparatus as viewed in the direction of an arrow D of FIG. 13, showing one step of operation of the developing unit change-over mechanism.
Figure 15:
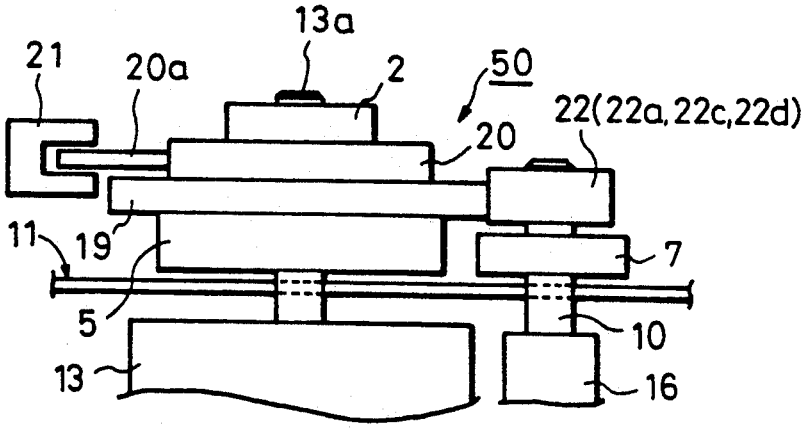
FIG. 15 is an illustration of the multi-color image forming apparatus as viewed in the direction of an arrow D of FIG. 13, showing another step of operation of the developing unit change-over mechanism.

A full-color printer, as a fourth embodiment of the image forming apparatus of the present invention, will be described with specific reference to FIGS. 13, 14 and 15. FIG. 13 is a side elevational view of a full-color printer showing a particularly a critical portion including the development unit change-over mechanism. FIGS. 14 and 15 are illustrations of the printer as viewed in the direction of an arrow D in FIG. 13, illustrating the operation of the developing unit change-over mechanism.

This embodiment employs a cam 19 of a large diameter which is provided with an indent **19*a* in the outer peripheral edge thereof. Rollers 22*a*, 22*b*, 22*c* and 22*d* and gears 7 are connected to the sleeve shafts 10*a* through 10*d* of the respective developing units 8*a* through 8*d*. Each sleeve shaft 10 is urged towards the center of the image carrier 13 by a suitable means which is not shown. The embodiment also employs a sensed member 20 which is provided with a light-shielding plate 20*a*. A light transmission type optical sensor 21 for optically sensing the presence of the light-shielding plate 20*a*** is mounted in the printer body.

In operation, the torque of the drive motor 1 on the printer body is transmitted through gears 35, 36,37 and 2 to rotate both the cam 19 and the sensed member 20 as a unit, whereby the developing units **8*a* through 8*d* are sequentially and selectively brought into operation. As will be seen from FIG. 13, the roller 22*b* of the developing unit 8*b* which has faced the indent 19*a* of the cam 19 leaves this indent 19*a* so that the gear 7 is brought into meshing engagement with the gear 5 as shown in FIG. 14, whereby the torque of the gear 5 is transmitted to the sleeve shaft 10. Consequently, the developing unit 8*b* alone is driven and put into developing operation. Meanwhile, the rollers 22*a*, 22*c* and 22*d* of other developing units 8*a*, 8*c* and 8*d* are in contact with the outer peripheral edge of the cam 19 where the indent 19*a* is not present, so as to keep the associated gears 7 away from the gear 5, as shown in FIG. 13. The developing units 8*a*, 8*c* and 8*d***, therefore, are inoperative.

The developing units **8*a* to 8*d* are sequentially and selectively brought into developing operation in accordance with the operation of the cam 19. The state or rotational phase of the cam 19 is detected by the optical sensor 21 which senses the light-shielding plate 20***a* of the sensed member 20. The change-over, .i.e., sequential selection, of the developing units 8 is performed in accordance with the state of the cam 19 detected by the optical sensor 21.

It will be seen that the second, third and fourth embodiments offer the same advantages as those produced by the first embodiment, since the sensors 15, 18, and 21 are disposed in the printer bodies in these embodiments.

In each of the embodiments described hereinbefore, any of the sensors 9, 15, 18 and 21 may be used also as a sensor which senses the absence or presence of the process cartridge or as a sensor which determines whether the process cartridge 11 has been mounted correctly.

More specifically, when the sensor 9 (15, 18 or 21) does not produce any output despite the starting of the drive motor 1, the control unit determines that the process cartridge 11 has not been mounted in the printer body 12, whereas, when an output is derived from the sensor, the control unit determines that the process cartridge 11 has been mounted. When the pattern of the signal output from the sensor 9 (15, 18 or 21) is different from a predetermined pattern which indicates the correct mounting of the process cartridge 11, the control unit 100 determines that the process cartridge 11 has been mounted in a wrong manner. It is also possible to identify the type of the process cartridge 11 mounted on the printer body through comparison between the pattern of the output signal from the sensor 9 (15, 18 or 21) with patterns stored in the ROM.

Figure 16:
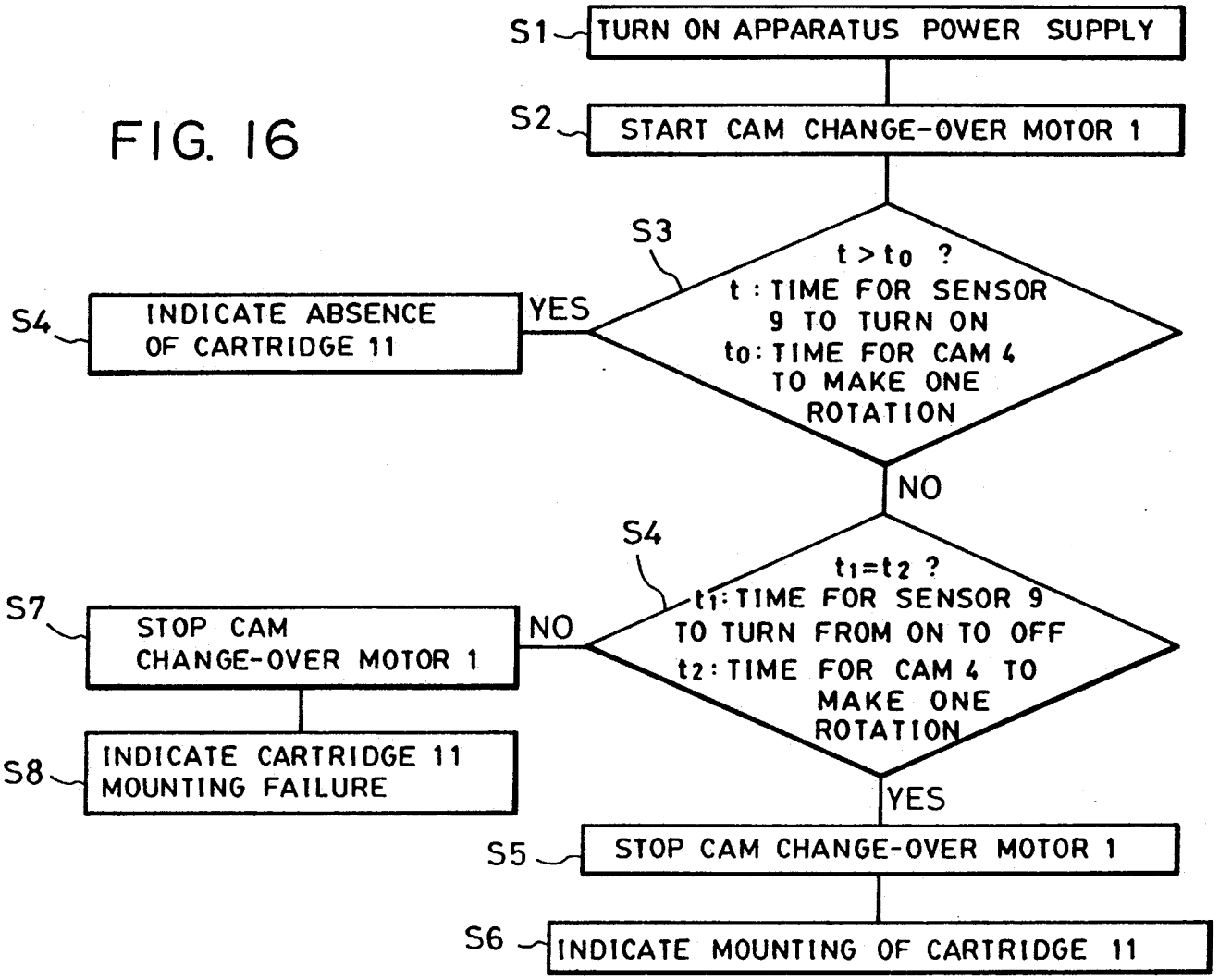
FIG. 16 is a flowchart showing a process for sensing absence or presence of a process cartridge, as well as the state of mounting of the process cartridge, on an image forming apparatus embodying the present invention.

A description will now be given of the process for detecting presence/absence of the process cartridge 11 and for determining the state of mounting of the process cartridge 11, with specific reference to FIG. 16.

The process for detecting presence/absence of the process cartridge 11 and for determining the state of mounting of the process cartridge 11 is executed, for example, when the power supply of the apparatus is turned on or when a cover or lid (not shown) of the printer body 12 is closed. A process triggered by turning on of the power supply will be described by way of example.

In Step S1, the power supply of the printer body 12 is turned on, so that the cam change-over motor 1 starts to operate in Step S2. Consequently, the sensed member 3, together with the cam 4, starts to rotate so that the projection 3*a* activates the sensor 9. A counter 101*a* in the control unit 100 starts counting simultaneously with the start of the cam change-over motor 1. In Step S3, the time (t) required for turning the sensor 9 on is compared with a time ($t_0$) which is the time required for the cam 4 to make one full rotation in ordinary operation. If the time (t) is longer than the time ($t_0$), the process proceeds to Step S4 which indicates, by lighting up of an indicator lamp, for example, the absence of the process cartridge 11 on the printer body 12. It will be understood that the sensor 9 is never turned on when there is no process cartridge on the printer body 12. The above-mentioned time ($t_0$) may be set to a value which is slightly longer than the exact time necessary for one full rotation of the cam 4. When the sensor 9 has been turned on within the time ($t_0$), the control unit 100 determines that the process cartridge has been mounted and proceeds the process to Step S4 which determines whether the process cartridge 11, which has been mounted in the printer body 12, is set in the correct state. This determination is conducted by deciding whether the gear 37 on the printer body 12 and the gear 2 on the process cartridge 11 have been put into correct meshing engagement. To this end, in this embodiment, the counter 101*a* in the control unit 100 starts counting simultaneously with the turning on of the cam sensor 9 to measure the time ($t_1$) from the moment at which the can sensor 9 is turned on until the moment at which the same is turned off. This time ($t_1$) is then compared in Step S4 with a time ($t_2$) which is the time required for the cam 4 to make one full rotation in the ordinary state, i.e., when the process cartridge 11 has been set correctly. When the time ($t_1$) equals to the time ($t_2$) or the difference between these times is within a predetermined tolerance, the control unit 100 determines that the process cartridge 11 has been correctly mounted on the printer body 12. In such a case, the process proceeds to Step S5 which stops the operation of the cam change-over motor 1 and then to Step S6 which indicates correct setting of the process cartridge 11 by, for example, lighting up an indicator lamp. If the difference between the time ($t_1$) and the time ($t_2$) is greater than the above-mentioned tolerance, the control unit determines that the process cartridge 11 has been set in a wrong manner although it actually exists in the printer body 12. In this case, the process proceeds to Step 7 which stops driving of the motor 1 and then to Step S8 which indicates mounting failure of the process cartridge the rough, for example, by lighting an indicator lamp. It is thus possible to detect presence/absence of the process cartridge and the state of mounting of the same.

Consequently, the necessity for a sensor and associated parts specifically used for the purpose of sensing mounting of the process cartridge 11 is eliminated to contribute to the reduction in the production cost of the whole apparatus.

Figure 18:
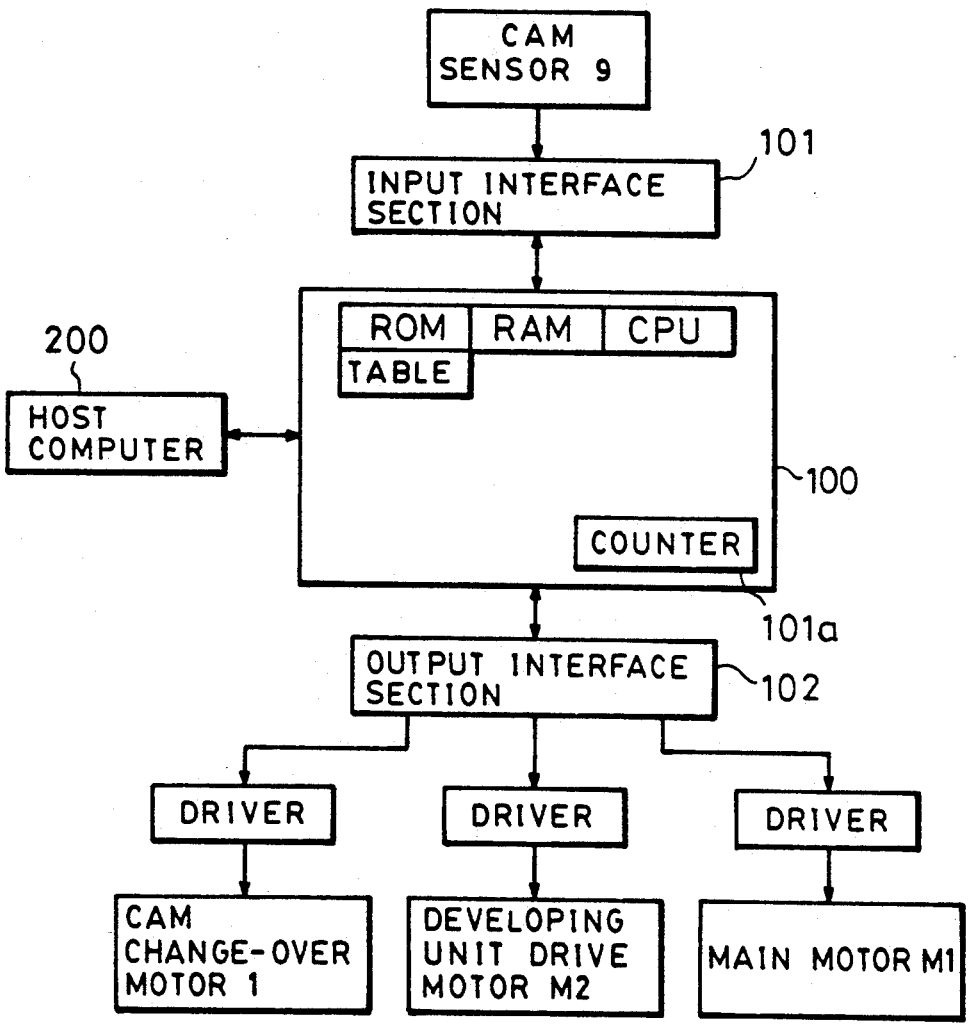
FIG. 18 is a block diagram of an image forming apparatus embodying the present invention.

FIG. 18 is a block diagram of a full-color printer embodying the present invention.

Referring to this Figure, the full-color printer has a control unit 100 which conducts the control of the whole printer. The control unit 100 incorporates a central processing unit (CPU), for example a microprocessor. The CPU produces various control signals in accordance with programs which are stored in the form of flowcharts in a ROM. The CPU also processes input signals received from the input interface 101 and delivers various signals to the output interface 102 thereby controlling the operation of the developing units 8 and other components. A RAM provided in the control unit 100 is used as a work area of the CPU and temporarily stores various data. The interface 101 receives the signal from the cam sensor 9, as well as signals from other sensors (not shown), and delivers them to the control unit 100.

The output interface 102 delivers to the motor drivers various control information signals which are derived from the control unit 100 and which are used for controlling the cam change-over motor 1, the developing unit drive motor $M_2$and the main motor $M_2$. The control unit 100 receives various control information from the host device 200 such as a computer.

Figure 19:
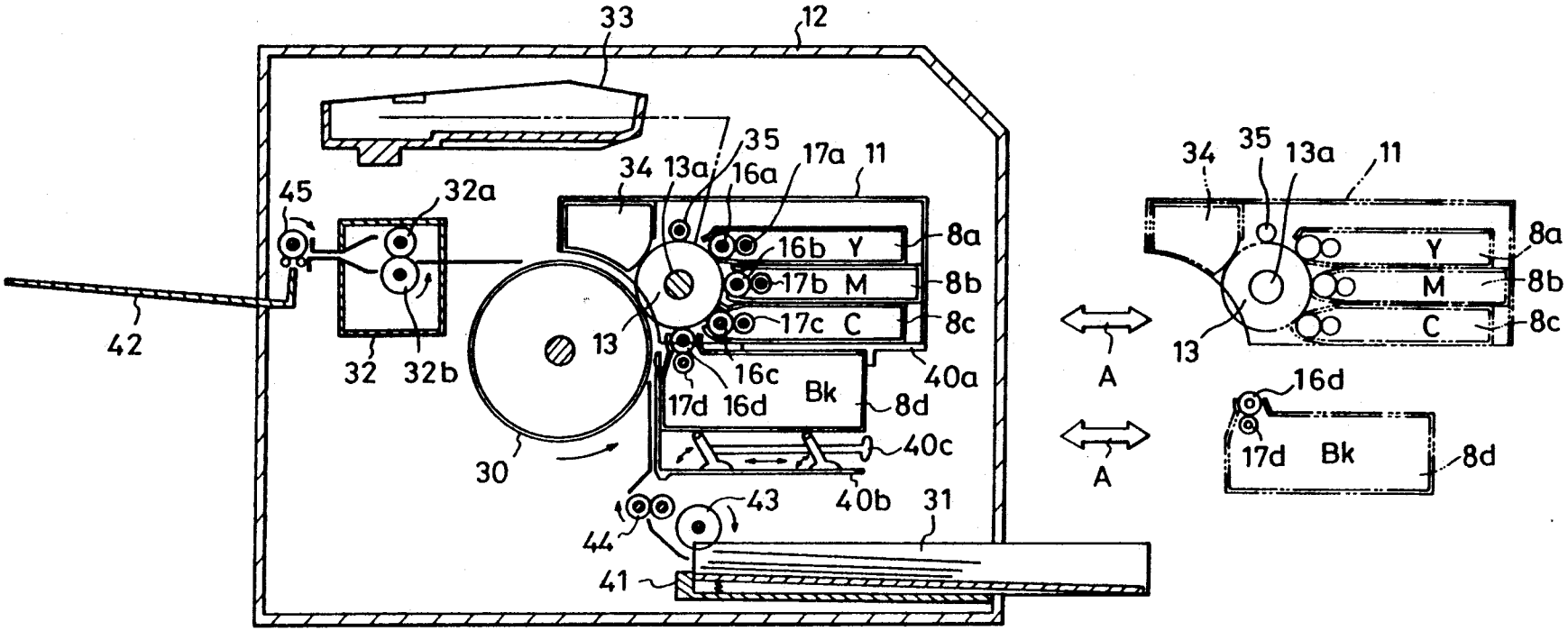
FIG. 19 is an illustration of an embodiment of the process cartridge in accordance with the present invention.

The process cartridge 11 used in the described embodiment is of the type which integrally has developing units 8 for yellow, magenta, cyan and black. This, however, is only illustrative. Namely, the present invention may be applied to an apparatus of a type which employs an independent developing unit for a specific color, e.g.,, black. An embodiment of such apparatus is shown in FIG. 19. In this embodiment, the process cartridge 11 is mounted on the mounting means 40*a* and the developing unit 8*d* for the black color is mounted on the mounting means 40*b*. Then, the lever 40*c* is pulled to raise the developing unit 8*d* for the black color to the operative position. The developing unit change-over mechanism 50 used in this embodiment may be of the same type same as one of those used in the preceding embodiment. Thus, the present invention is applicable to any type of process cartridge 11 which has, at least, an image carrier and a plurality of developing units. The process unit also may include at least one processing means which acts on the image carrier, such as a charger, a cleaning device or a lens system.

The multi-color image forming apparatuses described hereinbefore are of the type which form a color image on a recording medium by repeating a plurality of times a process including forming a latent image on the image carrier, developing the latent image and transferring the image onto the recording medium. The invention, however, can be applied to other types of multi-color image forming apparatuses such as, for example, a multi-color image forming apparatus in which a multi-color image is temporarily formed on an intermediate transfer member by superposing images of different colors by repeating a process including forming a latent image on an image carrier, developing the latent image and transferring the developed image onto the intermediate transfer member, followed by transfer of the multi-color image from the intermediate transfer member to a recording medium. It is also possible to apply the present invention to a multi-color image forming apparatus of the type in which images of different colors are superposed on an image carrier by repeating formation of latent image and development of the latent image, so as to form a multi-color image on the image carrier, followed by transfer of this multi-color image onto a recording medium.

It is to be understood that the term "multi-color image" is used to mean not only a so-called full-color image but also a two-color image, three-color image and so forth which are formed by superposing a plurality of monochromatic colors.

As has been described, the multi-color image forming apparatus of the invention is adapted to demountably mount a process cartridge including, at least, a plurality of developing units, an image carrier and a developing unit change-over mechanism. The developing unit change-over mechanism is driven by a motor which is disposed in the body of the apparatus, wherein a sensor for sensing the state of a change-over member of the developing unit change-over mechanism is disposed in the body of the apparatus separate from the process cartridge. The control of the change-over member is effected by the power from the body of the apparatus on the basis of the signal output from the sensor. According to the present invention, therefore, it is possible to facilitate mounting and demounting of the process cartridge on and from the body of the apparatus and to prevent erroneous operation of the developing unit change-over mechanism, while reducing the cost of the process cartridge.

As will be understood from the foregoing description, the present invention provides a process cartridge which can correctly operate a plurality of developing means without error, and also an image forming apparatus which can mount such a process cartridge.

The individual components shown in outline or designated by blocks in the Drawings are well known in the process cartridge and image forming apparatus arts, and their specific construction and operation are not critical to the operation or best mode for carrying out the invention.

The present invention has been described with respect to what is presently considered to be the preferred embodiment, it is to be understood that the invention is not limited to the disclosed embodiments. To contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process cartridge which can be mounted on an image forming apparatus, comprising:

an image carrier;

a plurality of developing units which act on said image carrier; and a developing unit change-over means for performing change-over between said plurality of developing units so as to put one of said developing units into an operative state, said developing unit change-over means being controlled in accordance with a signal from sensing means mounted in said image forming apparatus, for sensing the state of said developing unit change-over means.

2. A process cartridge according to claim 1, wherein said plurality of developing units form images of different colors.

3. A process cartridge according to claim 1, wherein said plurality of developing units comprises a yellow color agent container means for containing a yellow color developing agent.

4. A process cartridge according to claim 1, wherein said plurality of developing units comprises a magenta color agent container means for containing a magenta color developing agent.

5. A process cartridge according to claim 1, wherein said plurality of developing units comprises a cyan color agent container means for containing a cyan color developing agent.

6. A process cartridge according to claim 1, wherein said plurality of developing units comprises a black color agent container means for containing a black color developing agent.

7. A process cartridge according to claim 1, wherein said plurality of developing units comprises a yellow color developing unit, a magenta color developing unit and a cyan color developing unit.

8. A process cartridge according to claim 1, wherein said developing unit change-over means comprises a cam.

9. An image forming apparatus which can mount a process cartridge including an image carrier, a plurality of developing units which act on the image carrier and a developing unit change-over means for performing change-over between the plurality of developing units so as to put one of the developing units into an operative state, said image forming apparatus comprising:

mounting means for mounting the process cartridge;

driving means for driving the developing unit change-over means in the process cartridge mounted on the mounting means;

sensing means for sensing the state of the developing unit change-over means in the process cartridge mounted on said mounting means; and control means for controlling the operation of the developing unit change-over means in accordance with a signal output from said sensing means.

10. An image forming apparatus according to claim 9, wherein said process cartridge comprises a yellow color developing unit, a magenta color developing unit, a cyan color developing unit and a black color developing unit.

11. An image forming apparatus according to claim 9, wherein said process cartridge comprises a yellow color developing unit, a magenta color developing unit and a cyan color developing unit, and wherein said mounting means comprises means for mounting a black color developing unit separate from said process cartridge.

12. An image forming apparatus according to claim 9, wherein said process cartridge comprises an yellow color developing unit, a magenta color developing unit and a cyan color developing unit, and is formed as a unit separate from a black color developing unit.

13. A multi-color image forming apparatus, comprising:

mounting means for demountably mounting a process cartridge including a plurality of developing units, an image carrier and a developing unit change-over means having a change-over member;

a drive motor for driving said change-over member of said developing unit change-over means;

a sensor for sensing the state of said change-over member of said developing unit change-over means; and control means for controlling said change-over member from an exterior of said process cartridge in accordance with a signal from said sensor.

14. A multi-color image forming apparatus according to claim 13, wherein the absence or presence of said process cartridge and the mounting state of said process cartridge on said apparatus is determined on the basis of whether a predetermined signal is output from said sensor after a start of said drive motor.

15. A multi-color image forming apparatus according to claim 13, wherein said sensor is disposed substantially adjacent to a first power transmission member which transmits the power of said drive motor to a second power transmission member on said process cartridge.

16. A multi-color image forming apparatus according to claim 13, wherein said sensor is disposed substantially adjacent to said change-over member provided on a center of a shaft of said image carrier.

17. A multi-color image forming apparatus according to claim 13, further comprising means for supplying said drive motor with a stop lock current when said drive motor is stopped, to lock said drive motor in the stopped state.

18. A multi-color image forming apparatus according to claim 13, further comprising means for supplying said drive motor with a stop lock current only when said drive motor is stopped, to lock said drive motor in the stopped state and thereby either terminating the supply of the stop lock current or reducing the level of the stop lock current when one of said plurality of developing units is operating.

19. A multi-color image forming apparatus according to claim 13, further comprising means for supplying said drive motor with a stop lock current when said drive motor is stopped, to lock said drive motor in the stopped state, after reversing said drive motor by an amount corresponding to a backlash of the power transmission system between said drive motor and said change-over member.

20. An image forming apparatus, comprising:

a driving power source;

mounting means for removably mounting a process cartridge including an image carrier, a plurality of developing units which act on said image carrier, and a developing unit change-over means, which is movable, for transmitting driving power from said driving power source to one of said plurality of developing units; and a sensing means for sensing a position of said developing unit change-over means, wherein a sensing result thereby obtained affects the positioning of said developing unit change-over means.

21. An image forming apparatus according to claim 20, wherein said plurality of developing units comprise developing units which perform development of images in yellow, magenta and cyan colors.

22. An image forming apparatus according to claim 20, wherein said mounting means further comprises mounting means for mounting a black color developing unit separate from said process cartridge.

23. An image forming apparatus according to claim 20, further comprising a counter for counting the moving amount of said change-over means and a control means for controlling a stop position of said change-over means according to a count value of said counter.

24. An image forming apparatus according to claim 23, wherein said counter starts to count after said sensing means senses a position of said change-over means.

25. An image forming apparatus according to claim 23, wherein said control means stops the movement of said change-over means when said count value reaches the predetermined value.

26. An image forming apparatus according to claim 24, wherein said control means stops the movement of said change-over means when said count value reaches the predetermined value.

27. An image forming apparatus according to claim 26, wherein said predetermined value varies with the stop position.

28. An image forming apparatus according to claim 20, wherein said sensing means further senses whether said process cartridge is mounted on said mounting means.

* * * * *

UNITED STATES PATENT AND TRADEMARK OFFICE

CERTIFICATE OF CORRECTION

PATENT NO. : 5,276,479

DATED : January 4, 1994

INVENTOR(S) : Mitsugu Inomata

It is certified that error appears in the above-indentified patent and that said Letters Patent is hereby corrected as shown below:

COLUMN 6:

line 33, "the contain expensive" should read --containing the expensive--.

COLUMN 8:

line 21, delete "of the".
line 22, "mal-function" should read --malfunction--.
line 23, "he" should read --the--.

COLUMN 10:

line 8, "can sensor 9" should read --cam sensor 9--.
line 28, delete "the rough,".
line 59, "$M_2$and" should read --$M_2$ and--.

UNITED STATES PATENT AND TRADEMARK OFFICE

CERTIFICATE OF CORRECTION

PATENT NO. : 5,276,479

DATED : January 4, 1994

INVENTOR(S) : Mitsugu Inomata

It is certified that error appears in the above-indentified patent and that said Letters Patent is hereby corrected as shown below:

COLUMN 11:

line 8, "same" should be deleted.

COLUMN 13:

line 19, "an" should read --a--.

Signed and Sealed this

Fifth Day of July, 1994

*Attest:*

*Attesting Officer*

BRUCE LEHMAN

*Commissioner of Patents and Trademarks*